United States Patent [19]

Hignite et al.

[11] Patent Number: 4,502,375

[45] Date of Patent: Mar. 5, 1985

[54] FUME HOOD SASH OPERATOR

[75] Inventors: Alan L. Hignite; Richard L. Wendt, both of Midland; Roy F. Zeigler, Freeland; Warren L. Zeigler, Midland, all of Mich.

[73] Assignee: Tri City Laboratory Specialists, Inc., Midland, Mich.

[21] Appl. No.: 524,456

[22] Filed: Aug. 18, 1983

[51] Int. Cl.[3] ..... F23J 11/00

[52] U.S. Cl. ..... 98/115.3; 49/26; 49/200

[58] Field of Search ..... 98/115 R, 115 LH; 49/26, 29, 30, 200, 263, 264

[56] References Cited

U.S. PATENT DOCUMENTS

| | | | |
|---|---|---|---|
| 1,720,400 | 7/1929 | Peck | 98/115 LH X |
| 2,985,446 | 5/1961 | Marmont et al. | 49/200 |
| 3,021,130 | 2/1962 | Allerdice et al. | 49/264 |
| 3,370,381 | 2/1968 | Wetter | 49/26 X |
| 4,150,606 | 4/1979 | Nelson | 98/115 LH |

FOREIGN PATENT DOCUMENTS

| | | | |
|---|---|---|---|
| 531675 | 10/1956 | Canada | 49/26 |
| 2627894 | 1/1978 | Fed. Rep. of Germany | 49/200 |

*Primary Examiner*—Harold Joyce
*Attorney, Agent, or Firm*—Robert L. McKellar

[57] ABSTRACT

What is disclosed is a new and novel fume hood sash operator system and a fume hood containing such a system. The sash operator is constructed to operate with a belt drive and a clutch mechanism so that the sash member can be stopped, started, moved up or down to accommodate changes in the flow or air moving through the hood structure and to provide a safe, durable, energy-saving sash operating system.

14 Claims, 7 Drawing Figures

FUME HOOD SASH OPERATOR

BACKGROUND OF THE INVENTION

The instant invention deals with a sash operator for fume hoods and the fume hoods so equipped. Fume hoods are a common item of most every chemical laboratory and have been employed in one form or another for many years. As new materials and techniques are evolved, the fume hood undergoes modifications to attempt to ensure the working personnel freedom from spills and burns, noxious gases and chemicals. In recent years, this concern for safety has been coupled with a concern for energy conservation and certain modifications were made in standard fume hoods to ensure some energy savings while retaining the safety aspects of such hoods. For example, the air intake and exhaust ducts were adapted to electrical or pneumatic dampers or adjustable speed motors which would work to adjust motor speeds or duct openings in order to utilize only the mass of air that was required for safety purposes while not allowing large volumes of air to continuously pass through the fume hood and cause a waste of energy.

Another recent development in energy conservation was the use of an automatic fume hood sash operator which was electrically coupled with an automatic switch mechanism, such as a rubber floor switch mat, or a photo electric eye such as disclosed in U.S. Pat. No. 4,150,607, issued Apr. 24, 1979 to Laurence N. Nelson. The gist of that invention appears to be a sash operator which is actuated by a continuous cable loop carrying an activator switch which contacts limit switches which are built into the line of travel of the activator switch. A movable sash member of the hood structure is raised or lowered in correspondence to the movement of the activator switch. No provision is made in the Nelson invention for control of the sash member in a stop position if the sash member encounters an obstruction. Furthermore, the Nelson sash closer cannot be used in a fume hood where the counter-balancing weight for the sash member is required to be in the back of the unit. Finally, it is obvious that the Nelson invention would not be readily adaptable to existing fume hood structures since the design of the closure mechanism requires the counter-balancing weights to be positioned in the path of the control units for the hood, thus requiring extensive modification of hoods that are in place and functioning today.

BRIEF SUMMARY OF THE INVENTION

The instant invention is directed to a new and novel means of controlling the size of the access opening in dependence upon the presence or absence of operating personnel, whereby the sash member of the fume hood may be moved into a closed or partially closed position and opened or partially opened position. In addition, the instant invention deals with a means of protecting operating personnel since a means for interrupting the movement of the sash member in the access opening at any point in the cycle of opening and closing of the sash, is provided.

Further, the instant invention deals with a manual override switching system in which the flow of air via the blower motors, the duct dampers and the sash member can be manually controlled outside of the inner connected electrical system of the hood.

The instant invention also includes a fume hood into which the sash operator is incorporated since the use of the inventive sash operator in a fume hood allows for new and novel functions for such a fume hood, which heretofore were not available.

The inventive sash operator is adaptable to almost any hood system of almost any design and even though it is primarily designed for newer, more modern designs of hoods, the instant invention can be readily adapted to existing hood structures.

Some of the newer hoods in use today have such features as occupying small spaces, controlled operation of exhaust blowers and auxiliary blowers and many other such functions and the instant invention can and does allow these functions to be incorporated in the design of the hoods owing to the very limited space that the sash operator of the instant invention needs to occupy.

In one embodiment of the invention, an adjustable clutch mechanism is provided to a cable operation which allows the precise opening, closing, stopping and starting of the sash member within the access opening. A sash control cable is provided which is connected to and extends from the sash member through a series of pulleys to a freely movable, often hidden, weighted member. Along the line of travel of the sash control cable, the cable moves around a master cable pulley which drives the sash control cable to control the sash member and the counter-balancing weight simultaneously.

The master cable pulley is part of a dual pulley system in which there is one pulley but two different sized and shaped grooves which account for a V-belt adaptation on the top groove and the master cable on the bottom groove. The single pulley, dual groove system is designed to give the cable system a positive traction and to prolong the life of the master cable. Dual pulleys on the same shaft, hence a dual groove system, tends to allow non-positive traction, i.e. slippage and cause the cable to wear excessively.

The master cable dual groove pulley is driven in turn by a conventional V-belt, which belt is driven by a pulley connected to a power source, such as an electric motor. In the case of the instant invention, a single-phase, reversible motor is necessary.

The V-belt surrounding the drive pulley and the top groove of the master cable pulley is caused to contact and be driven by the drive pulley by means of a clutch mechanism in which an idler wheel, mounted on the distal end of a clutch arm, is disposed between and at the same height as the aforementioned drive and master cable pulleys, at the top groove, and between and at the same height as the traveling belt. A solenoid controls the movement of the clutch arm in a reciprocal horizontal motion, which in turn engages and causes pressure on the V-belt which causes the belt to engage the drive pulley to drive the belt, or disengages and decreases the pressure on the V-belt which causes the belt to disengage the drive pulley which stops the drive pulley from driving the belt.

The clutch mechanism is electrically wired with a conventional solid state timer and relay and the electric motor which provides the drive power for the drive pulley. The motor which provides the power is adapted to a gear rod driven limit switch means which in conjunction with activation means, timer and relay and limit switch means, controls the sash member in a detailed manner as described below.

DETAILED DESCRIPTION OF THE DRAWINGS

Figure 1:
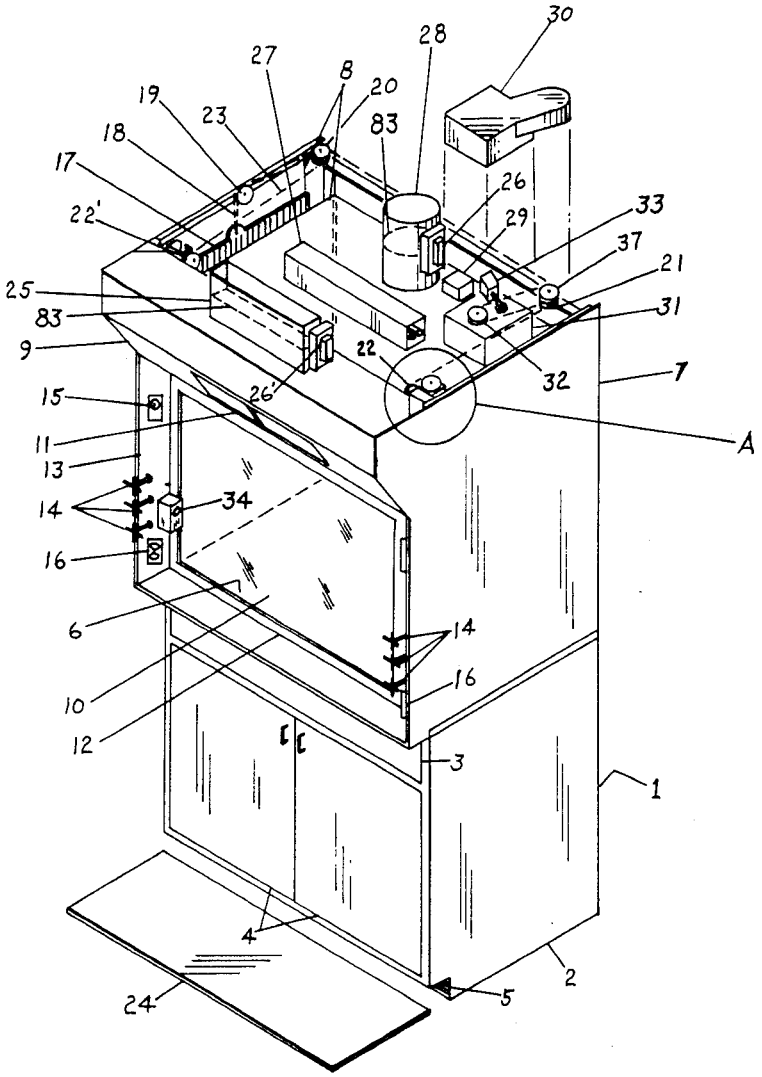
FIG. 1 is a view in perspective of a fume hood structure showing the clutch and drive mechanism of this invention in place.

Referring to the drawings and more specifically to FIG. 1, there is illustrated a conventional laboratory fume hood structure upon which is mounted, one inventive embodiment, the clutch mechanism and its power source and controls.

The laboratory fume hood illustrated comprises a basic hood structure which includes a base structure 1 having a pair of end walls 2 (only one of which is shown), and a front wall 3 (illustrated showing hinged doors 4 for access to the underside of the hood) having an inwardly offset bottom portion 5. At the top of the base structure is a work surface 6 which is surmounted and enclosed by a hood structure 7 which has a double wall construction, the double walls shown at 8. A front wall 9 extends across the upper portion of the front of the hood defining below it an access opening 10. One embodiment of the front wall is shown which is an inwardly, downwardly sloping wall which can accommodate an auxiliary air grill 11 which will be considered in detail infra. There is provided in the access opening a vertically movable sash member 12, shown as a transparent window framed by a metal casing. The side and bottom portions of the hood structure adjacent the access opening 10 are provided with respective fascia panels 13, the side panels of which may be provided with controls 14 and other accessory means such as switches 15, electrical outlets 16, and control light panels (not shown) for the control of the equipment of the fume hood.

Hoods such as illustrated in FIG. 1 are normally provided with counterbalancing weights for the movable sash disposed in the access opening, and in the hood structure illustrated, the sash is adapted to be counterbalanced by a weight 17 which is connected by a suitably strong cable 18 (the connection and the weight being illustrated on the left hand side of the hood), with such cable extending upwardly from the weight 17 and over a freely rotatable side weight converter pulley 19, the cable continuing to extend towards the back wall of the hood structure and around a horizontally mounted freely rotatable hood cable pulley 20, the cable continuing to extend across the back of the hood structure and around a second horizontally mounted, freely rotatable hood cable pulley 37/21, and then the cable is extended towards the front of the hood structure to and over a second vertically mounted freely rotatable side weight converter pulley 22 where the cable is extended downwardly and connected to the side of the movable sash member.

The second cable 23 is provided on the left hand side of the sash member so that the sash member moves in a truly vertical line without binding in the guide channels (which retain the sash member in its upright position and guide the sash in its up and down movements, not shown). The cable 23 is connected to the left-hand side of the sash member and the cable extends upwardly to and over a vertically mounted freely rotatable side weight converter pulley 22' whereupon the cable 23 extends towards the rear of the hood structure to and around a horizontally mounted freely rotatable pulley 20 whereupon the cable reverses direction and extends towards the front of the hood structure and over the side weight converter pulley 19 and lays in tandem in pulley 19 with cable 18 at which point the cable extends over pulley 19 and downwardly to the weight 17 where it is attached. It should be noted that the cable 23 should be mounted on pulley 20 in the inside-out position (opposite the mounting of cable 18 on pulley 20) so that the cables 18 and 23 move in tandem to lift and lower the weight 17.

The structure shown and the cable assembly are merely one embodiment of the invention and should not be construed as limiting the invention.

In addition, the hood structure is illustrated in FIG. 1 as showing a floor mat 24 with a switch means 73 (FIG. 6), an air induction duct 25, two, two-position motorized damper assemblies 26 and 26', a fluorescent light fixture 27, an exhaust duct 28 containing a damper 83 shown in phantom, a junction box 29, a motor box safety cover 30, a motor box 31, a drive pulley 32, a clutch assembly 33 and a photo cell 34, all of which will be described in detail infra.

Figure 2:
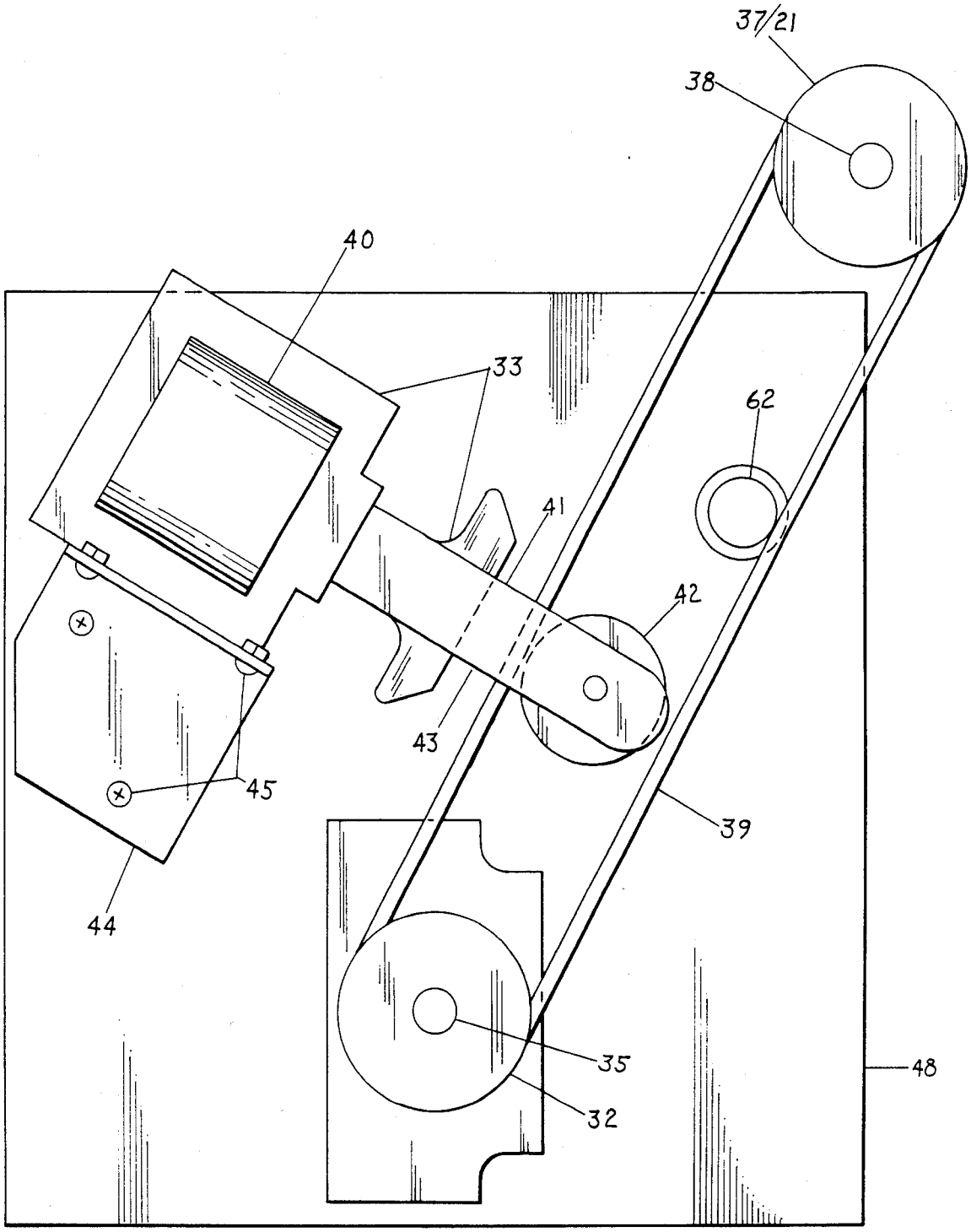
FIG. 2 is a top plan view of the motor box showing the clutch and V-belt pulley system.
Figure 3:
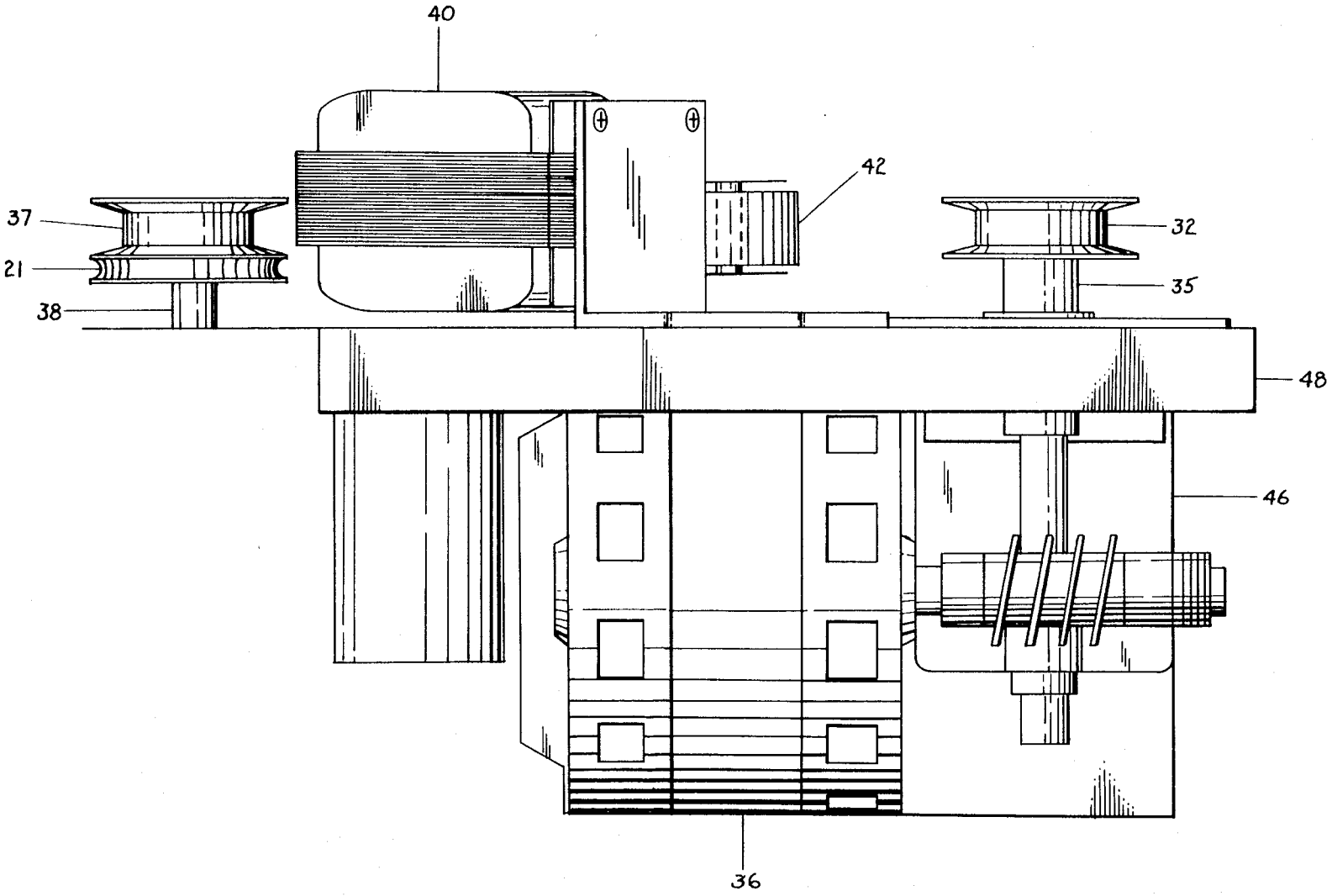
FIG. 3 is a left plan view of the motor box assembly.

Turning now to FIG. 2 which is a top view of the back right hand corner of the fume hood structure which illustrates, with the motor box cover removed, a drive pulley 32 mounted on a shaft 35 which is driven by a motor (shown in FIG. 3 as 36).

Also shown is a dual grooved master cable pulley 37/21 (FIG. 2) which is a single pulley with dual grooves. The top-most groove 37 (FIG. 3) is adaptable to a standard V-belt. The lower-most groove 21 is adaptable to the master cable. Obviously, when the dual grooved pulley is mounted on the vertical shaft 38, the grooves would rotate at the same speed and in the same direction. The dual grooved master cable pulley 37/21 and the drive pulley 32 are connected together in a non-friction state by a V-belt 39. Also shown in FIG. 2 is the clutch mechanism 33, consisting of a solenoid 40, a clutch arm 41 and a freely rotatable V-belt pulley or wheel 42 mounted horizontally in the distal end of the clutch arm 41. The arm 41 is provided with a slot 43 (shown in phantom) through which the belt moves when the belt is in operation. Shown also in FIG. 2 is a mounting bracket 44 with suitable bolts or screws 45 to assure a secure attachment to the motor box deck 48. The solenoid 40 is electrically connected to a power source and when charged, the solenoid draws the arm 41 towards itself which causes pulley 42 to impinge tightly on belt 39 which in turn transfers the movement of drive pulley 32 to pulley 37/21. When the solenoid 40 is not energized, the clutch arm 41 draws away from the solenoid which causes disengagement of the V-belt from the pulley 42 which allows the V-belt to cease its movement, even though pulley 32 continues to rotate by action of the running motor. Obviously, when pulley 32 does not transfer the movement to pulley 37/21, that pulley comes to rest.

FIG. 3 is a side veiw of the motor 36, the pulley system constituted of pulleys 32, 37/21 and the solenoid 40 with the clutch arm 41 retracted into the solenoid so that only the wheel 42 is shown. The drawing does not show the V-belt in place. The purpose of the figure is to give clarity to the illustration in FIG. 2 and to show the motor 36 and the gear box 46 which transfers the power of the motor 36 to the vertical shaft 35.

Figure 4:
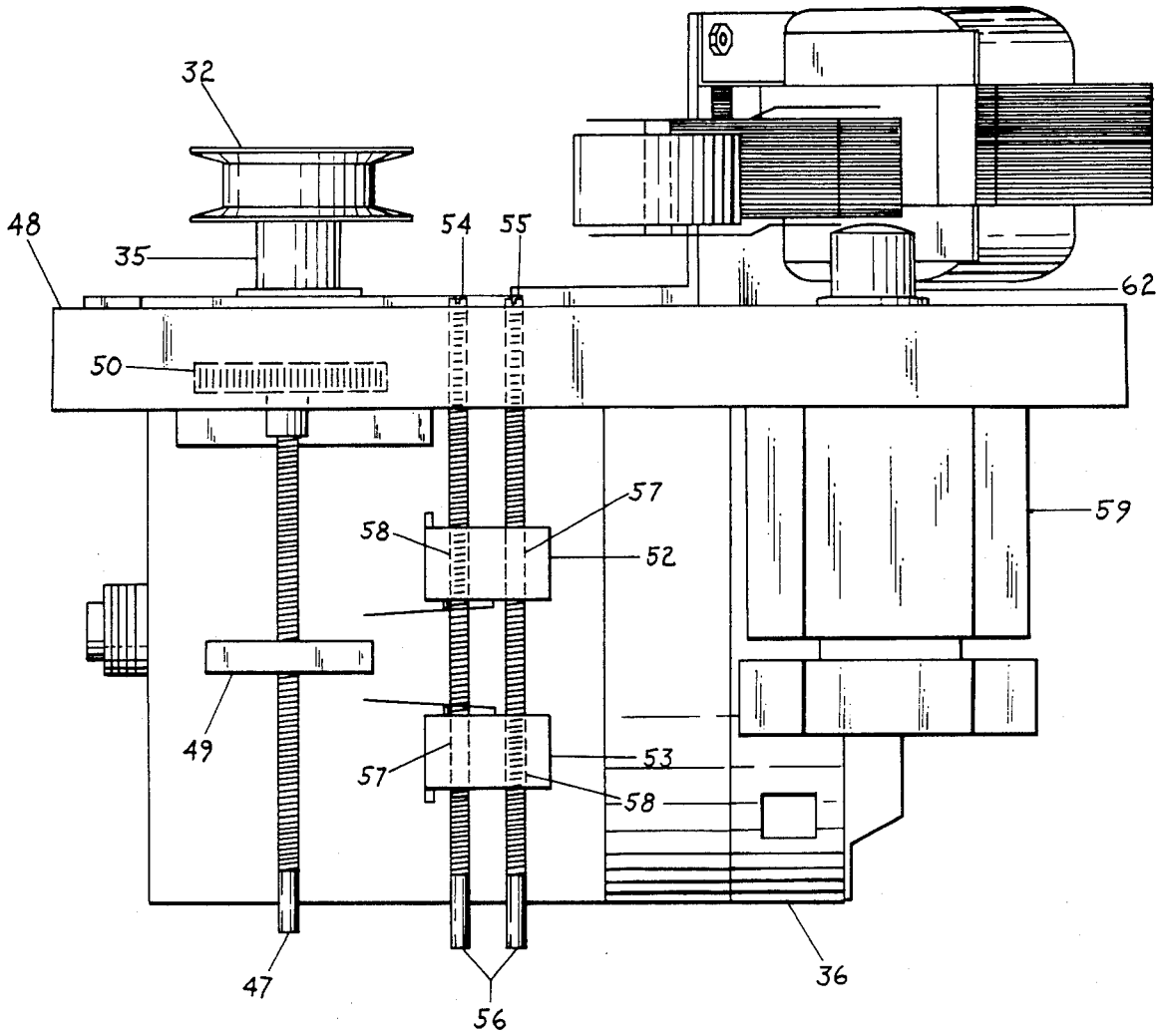
FIG. 4 is a right plan view of the motor box assembly.
Figure 5:
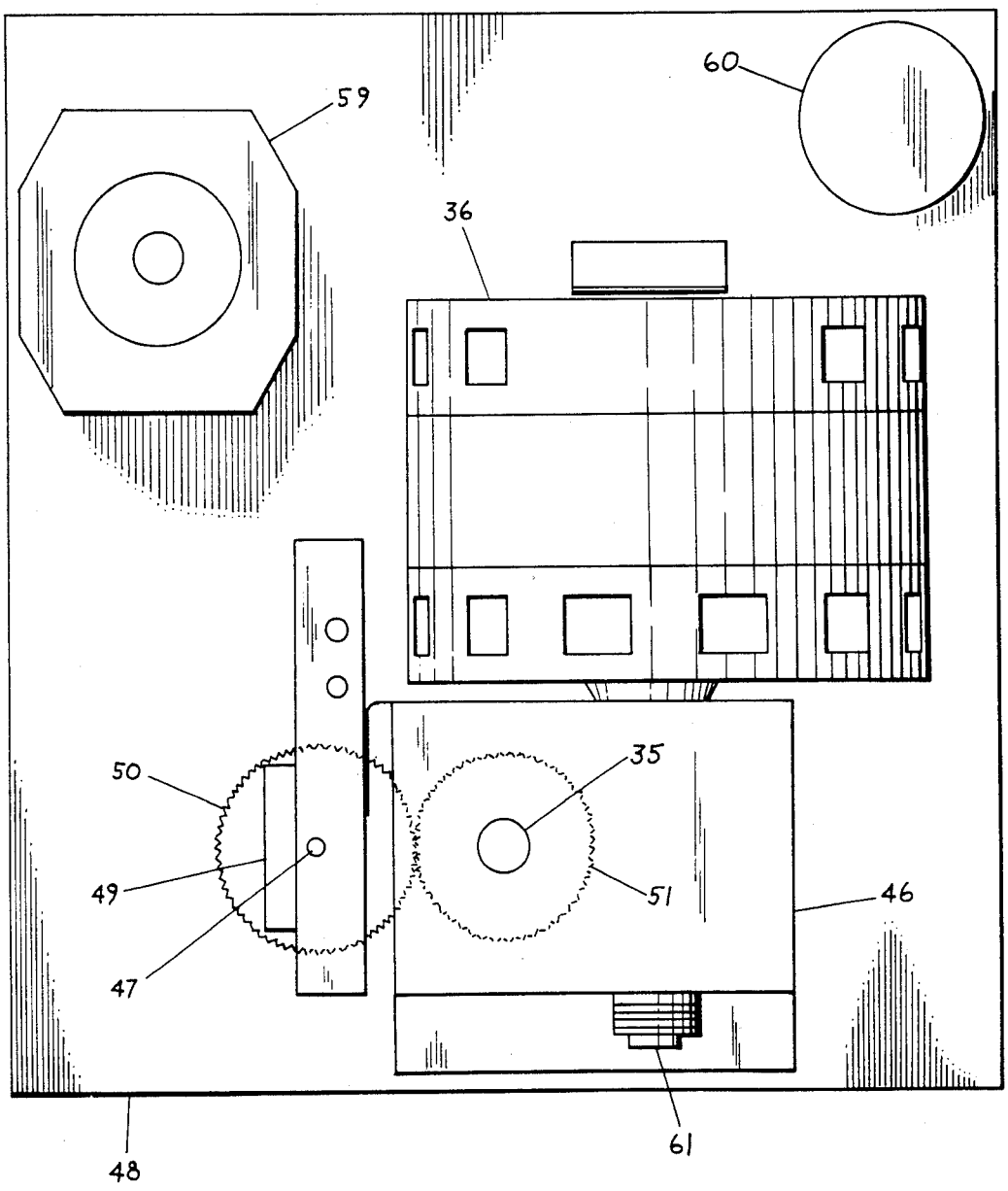
FIG. 5 is a bottom plan view of the motor box assembly.

FIG. 4 is an opposite side view from FIG. 3 of the motor box with the motor cover removed and the motor 36 and a solid state timer and relay 59 shown on the right bottom, and a timer-adjustment knob 62. A threaded gear rod 47 is mounted below the deck 48 and parallel with the shaft 35 (shown in FIG. 3). Approximately midway along the gear rod there is mounted, in a horizontal position on the rod, a threaded limit switch activator 49 whose threads mate with and coordinate with the threaded rod 47 such that when the threaded rod 47 rotates, in position, the limit switch activator 49 moves up and down the threaded rod 47 and contacts limit switches which will be discussed infra. At the upper most end of the threaded rod 47, there is permanently mounted on the threaded rod 47 in a horizontal position, a limit switch activator gear 50 which engages with an interfacing limit switch gear 51 (FIG. 5, in phantom). Said limit switch gear 51 is permanently mounted in a horizontal position on the shaft 35 (see FIG. 5). When the shaft 35 is gear driven by the motor, the limit switch gear 51 is driven in the same direction. Because of its geared interface with limit switch activator gear 50, the threaded rod 47 rotates and the limit switch activator 49 moves up or down the threaded rod 47. For example, if the shaft 35 rotates in a clockwise direction, the limit switch gear 51 turns in a clockwise direction and the limit switch activator gear 50 would turn in a counter-clockwise rotation driving the threaded rod 47 in a counter-clockwise motion, allowing the limit activator switch 49 to move downwardly. When the shaft 35 rotates in a counter-clockwise motion, all of the movements are reversed which results in the movement of the limit switch activator in an upwardly direction.

The movement of the limit switch activator is impeded by two limit switches 52 and 53. The down limit switch is 52 and the up limit switch is 53. These switches are adjusted some distance apart by adjusting rods 56 by means of screw slots 54 and 55 (FIG. 4). As can be observed from FIG. 4, the limit switches are mounted on two threaded rods 56. Each switch contains two parallel holes 57 which pass completely through the switch housing and allow the passage of the rods 56. One hole 58 in each housing is threaded to match the threads of the threaded rod and, each block has a non-threaded hole which is slightly larger than the diameter of the rod 56 which allows the block to glide over the threaded rod without impediment. This arrangement allows the block to move via the threaded rod in order to accomplish adjustment, while the block is being guided in a parallel path by the non-threaded hole passing over the other, parallel, threaded rod. The switches are preadjusted by the use of the rod adjustment screw slots 54 and 55 in rods 56 to a distance which will allow time for the limit switch activator to travel between them.

FIG. 5 is a bottom view of the motor box 31 and is shown for clarification of the points set forth above for FIG. 4. Referring to FIG. 5, there is shown the motor 36, the gear housing 46, a motor capacitor 60, limit switch gear 51 in phantom and the vertical mounting shaft 47 for the limit switch gear and the horizontal gear shaft 61.

Figure 7:
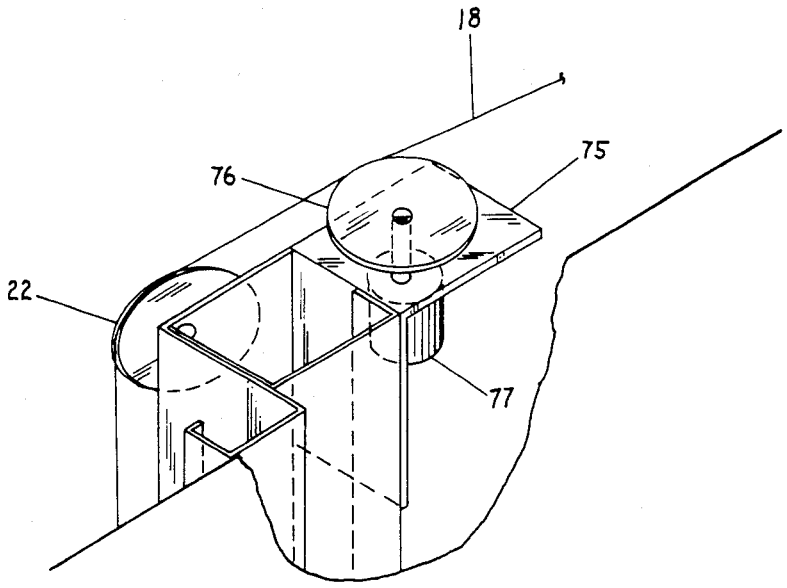
FIG. 7 is a cutaway, blow-up of region A in FIG. 1 and shows the assembly of the speed potentiometer, one of the features of the invention.

FIG. 7 is a cutaway view of the hood structure as illustrated in FIG. 1 and is a section marked A showing a further embodiment of this invention.

There is shown in FIG. 7 a mechanically driven speed potentiometer control which controls the flow of air by controlling the blower motors. The purpose of the speed potentiometer is to further enhance the energy saving features of the instant invention, in that, the control significantly decreases the loss of room-conditioned air by adjusting the access opening of the hood through manipulation of the sash.

Turning to the FIG. 7, there is shown a mounting bracket 75 which is securely mounted to the hood structure. The potentiometer 77 is mounted vertically on the bracket such that the aluminum pulley 76 falls in line with cable 18 (shown and discussed supra). Also shown is cable pulley 22. As the sash member is raised and lowered, the cable 18 nudges the pulley 76 with enough frictional contact to turn the aluminum pulley. When electrically energized, the potentiometer is capable of increasing or decreasing volts from 1 to 10, depending on how many turns and in what direction the pulley moves. As the sash moves up, the aluminum wheel turns clockwise and the voltage is increased. As the sash moves down, the aluminum wheel reverses direction and the voltage is decreased. Since the potentiometer can be electrically interlocked with, say, an inverter, the potentiometer has the potential to operate fan motors which require more voltage. In other words, the potentiometer acts as a rheostat on the fan motors.

The potentiometer can be adjusted by using larger or smaller diameter wheels 76. It should be noted that both the high rate of air flow and the low rate of air flow are adjustable.

Modern electric inverters have the capability of controlling the fan speeds of more than one motor at the same time. Thus, when synchronizing auxiliary and exhaust air fans in the fume hood, the same speed potentiometer can be used to control one inverter to serve both motors.

When using a speed potentiometer in conjunction with electric inverters, the use of dampers in the ducts may be eliminated.

In the operation of the sash member it is desired to have the ability to instantly stop or start the movement of the sash member without interruption of or strain on, the power source. It is also desirable that once the movement of the sash member has been interrupted, it can automatically resume such movement to either finish opening or finish closing the sash member. In this manner, the sash member can be automatically opened or closed; it can be interrupted when it is moving into the open or closed position without damage to the element which obstructed the movement of the sash member and, once interrupted, the sash member can pause, then continue and finish the cycle of its intended movement. For example, in a chemistry laboratory wherein this invention was being used, and the hood of this invention was adapted to a rubber floor mat switch, or perhaps operated by a photo electric eye and associated means, the sash would automatically close when the operating personnel moved away from the hood front. In the prior art hood system such as that found in U.S. Pat. No. 4,150,606, if a glass beaker, for example, were carelessly left in the path of travel of the sash member when it was closing, the sash member would contact the glass beaker and the sash would stop. The motor would continue to rotate the drive pulley which would result in a burned out motor or an abraded cable, whichever occurred first owing to the fact that the cable would never drive the limit switch activator to its destination at the limit switch.

In the instant invention, however, given the same set of circumstances as above, when the sash member strikes the glass beaker, the sash member immediately stops, lightly rests against the object for a pre-set period of time (perhaps 1–2 seconds) and then the drive means for the sash member is automatically disengaged and the sash member remains in the stop position. It will not open and provide an energy loss, nor will the sash oscillate in the access opening. The sash will remain in the obstructed open position until the operating personnel removes the object and reactivates the drive means for the sash member, at which point the system will automatically recycle the sash member to a fully closed or fully opened position, depending on the presence or absence of operating personnel.

The invention herein is also designed so that there may be incorporated means for controlling the operation of exhaust blowers, for example, multiple speed blowers, or auxiliary air blowers.

The sash member may be controlled in response to the presence or absence of operating personnel by any one of many types of switch mechanisms, for example, rubber or plastic floor mat switches, photo electric eyes or manual switches. Also, to prevent undesired operation of any kind, a suitable time delay device may be included to prevent activation of the sash.

The electrical circuits, as described in detail infra, include relay means for operating exhaust blowers and auxiliary air make-up blowers, whereby, in addition to controlling the opening, closing, stopping and starting of the sash member, the high-low speed of the blowers may also be controlled so that they will be operated at high speed when the sash member is in a raised position and operated at a lower speed when the sash member is in a lowered or closed position. If an auxiliary air blower is also provided, it may be suitably connected to operate, for example, only when the exhaust blower is operating at high speed or it can be complimentary or supplemental, as needed.

While the use of auxiliary air will reduce the quantity of conditioned room air withdrawn during operation of the fume hood, the auxiliary air is normally supplied at around 60° F. and may require heating the air to such temperatures. Therefore, if the auxiliary air is not necessary, it can be discontinued and the energy savings alluded to supra can be realized. This short discussion of auxiliary air blowers covers the state of the art in fume hoods and a detailed discussion of the manual override for the air handling system will be covered in detail, infra.

THE ELECTRICAL CONTROLS

Figure 6:
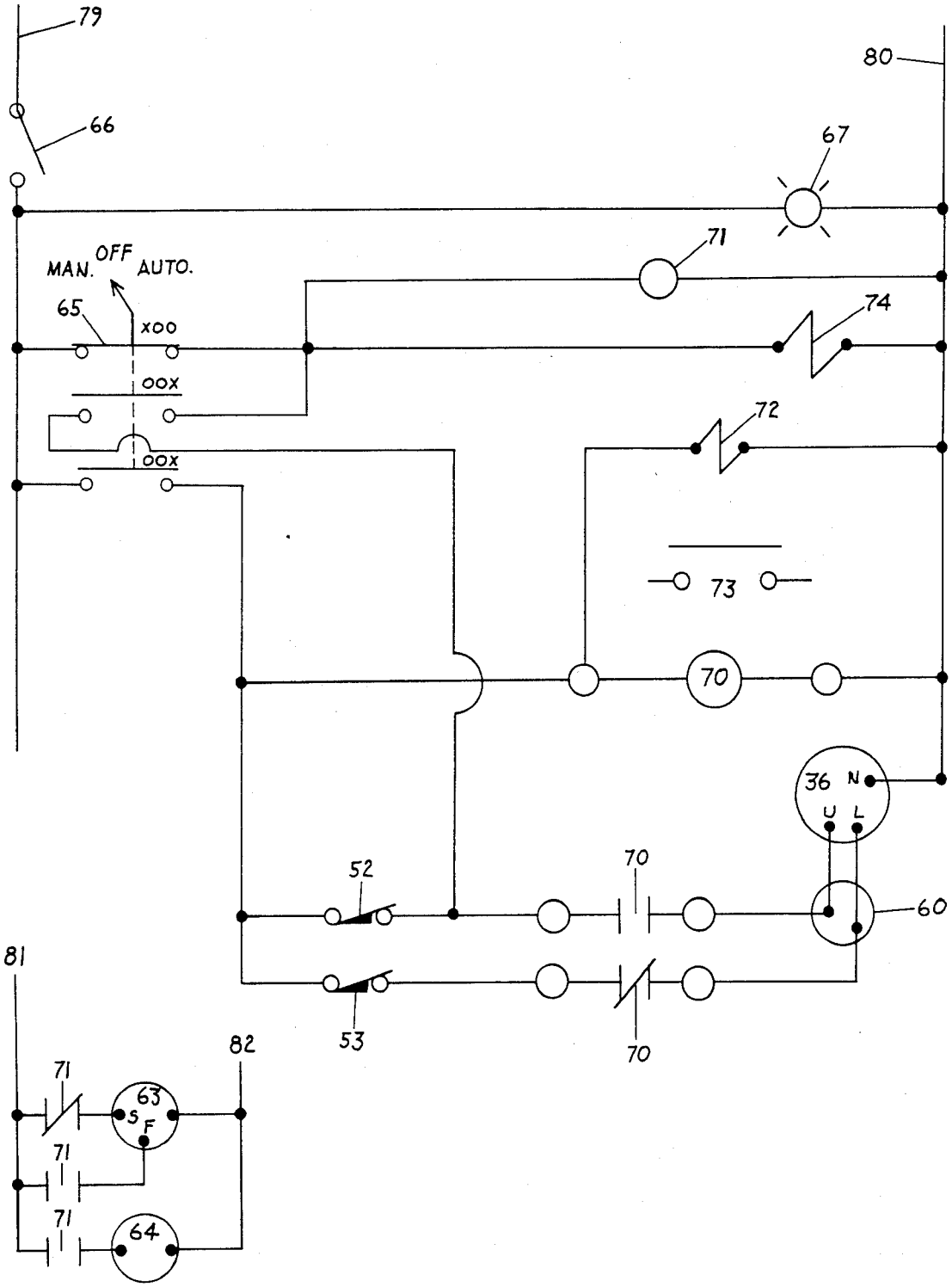
FIG. 6 is an electrical schematic of one of the ways in which the invention can be wired.

FIG. 6 illustrates our wiring diagram pertaining to the instant invention, in which the motor 36 is a reversing 110 V motor; 63 is a two-speed 110 V exhaust fan motor; 64 is a single speed 110 V intake fan motor; 65 is a three position selector switch with auxiliary contacts; 66 is single pole switch; 67 is a 110 V pilot light; 52 is a lower limit switch which is held open when the sash is closed; 53 is an upper limit switch which is held open when the sash is open; 70 are delay-on-release relays, double pole, double throw, externally activated switches; 71 are 110 V relay switches with three contacts; 72 is a clutch solenoid switch; 74 is the air damper solenoid switch and 73 is the proximity or floor mat switch. The proximity or floor mat switch are mate switches which normally open, but when activated, go to the close position.

In actual operation, and without too much detail, 79 is the main power source and 80 is neutral and for motors 63 and 64, 81 is the power source and 82 is neutral, and when switch 66 is closed and switch 65 is set in the manual position, the pilot light 67 will so indicate by being lighted. Relay 71 is now energized and the motor 63 is now turning at high speed and motor 64 is on and at the same time, solenoid switch 74 is activated opening the exhaust damper (not shown) located in the exhaust duct 28 (FIG. 1). At this point, the sash can be raised and lowered manually as solenoid switch 72 allows the arm 41 (FIG. 2) of the clutch mechanism to extend and decrease the friction on the drive belt 39 (also FIG. 2).

When switch 65 is in the off position with switch 66 closed, motor 63 is rotating slowly and solenoid switch 72 still allows the arm 41 of the clutch mechanism to extend and decrease the friction on the drive belt 39. At this point, the pilot light is still on. This is the manual override situation eluded to earlier in the specification, which contributes to the safety of this inventive system.

When switch 65 is in the auto position, the pilot light 67 is on and solenoid switch 72 is energized, retracting arm 41 of the clutch mechanism, and increasing the friction on the drive belt 39 and the drive pulley 32 (FIG. 2) and allowing for control of the sash. The release relay 70 is now powered.

In order to now activate the sash, the switch 73 must be closed, for example by a working person stepping on the floor mat 24, releasing power from the relay 70 until the limit switch activator 49 (FIG. 4) reaches the upper limit switch 53 (also FIG. 4). At this point, limit switch 52 is closed allowing the relay 71 and solenoid switch 74 to be energized, whereupon motor 63 will be at high speed and motor 64 will be activated, and cause the exhaust damper and the air intake damper 83 to open.

These conditions will remain for a pre-set delayed time, such as for example, 10 seconds, or as long as the proximity (floor mat) switch 73 is activated. As soon as the switch is deactivated, the delay occurs.

When the proximity switch 73 is not activated, the limit switch 52 will power the activated contact for the relay 70, energizing the reversing mode on motor 36, which will reverse the cable system and close the sash. The sash will stop when the limit switch activator 49 mates with limit switch 52 and the relay 71 and solenoid switch 74 will de-energize, causing the exhaust damper to close, the motor 63 to slow down and motor 64 to stop. If at any time the sash is moving downward and the proximity switch is activated, the sash will stop, reverse direction, and open.

In the situation described earlier in this specification, in which a beaker is inadvertently left in the path of the travel of the sash and interrupts the downward movement of the sash, or in a situation where it is desired that the sash be held partly open with a slow blower fan speed, switch 65 is placed in the off position, i.e. the switch is open, the blower fan at this point can be increased in speed by turning switch 65 to the manual position. In either event, if there is an obstruction to keep the door open, the motor 36 will continue to operate until the limit switch activator 49 (FIG. 4) has encountered and switched the limit switch 52, at which point the sash will stop. When the sash is reactivated, usually manually, the sash will rise and reseat itself in the normal up position. This is accomplished by activating a switch (in our example the floor mat switch) which causes motor 36 to operate, which in turn operates the gears 50 and 51 (FIG. 4) and the solenoid switch 72 to de-energize the solenoid 40 (FIG. 2) allowing the clutch arm 41 to extend and decrease the friction on the V-belt and allowing the belt to slip on the drive pulley 32; with the limit switch activator traveling to limit switch 53 and shutting down the motor 36. Upon closing, the sash will come to rest in its normal down position.

That which is claimed is:

1. A sash operator for a fume hood structure, said fume hood structure having an access opening in one wall thereof and a closure structure therefor, including a movable sash member, disposed for movement in said access opening to vary the effective size of the opening thereof, comprising a power source mounted on a stationary portion of the structure and having attached thereto, by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable connected to said sash member as a means of controlling said sash member, the cable extending between the sash member and a hood idler pulley which has been vertically mounted on said structure, said cable continuing over the first hood idler pulley extending to and over the dual grooved master cable pulley, the cable continuing to and over one or more further hood idler pulleys which have been mounted on said structure, said cable terminating and connecting to a freely moving weighted structure within the hood, a means of controlling the action of the solenoid and a means of controlling said power source to control the movement of the cable and the movement of the clutch arm to control the movement of said sash in said access opening.

2. A sash operator for fume hood structures as claimed in claim 1, wherein said power source is an electric motor and the controlling means therefor comprises limit switches disposed in an area adjacent to the power source and actuatable by means comprising a limit switch activator in a geared relationship to the power source.

3. A clutch and drive mechanism to provide a sash member operation for fume hood structures comprising a power source mounted on a stationary portion of the fume hood structure and having attached thereto by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the hood idler pulley extending to and over the dual grooved master cable pulley, the cable continuing to and over one or more further hood idler pulleys which have been mounted on said structure, said cable terminating and connecting to a freely moving weighted structure within the hood.

4. A clutch and drive mechanism as claimed in claim 3 wherein said power source is an electric motor and the controlling means therefor comprises limit switches disposed in an area adjacent to the power source and actuatable by means comprising a geared relationship to the power source.

5. A clutch and drive mechanism as claimed in claim 3 wherein the clutch arm is controlled by a solenoid which is activated by an electric switch.

6. A clutch and drive mechanism as claimed in claim 3 wherein the clutch arm is controlled by a solenoid which is activated by an electro-pneumatic switch.

7. A fume hood having a sash operator, said fume hood having an access opening in one wall thereof and a closure structure therefor, including a movable sash member, disposed for movement in said access opening to vary the effective size of the opening thereof, comprising a power source mounted on a stationary portion of the structure and having attached thereto, by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the first hood idler pulley extending to and over the dual grooved master cable pulley, the cable continuing to and over one or more further hood idler pulleys which have been mounted on said structure, said cable terminating and connecting to a freely moving weighted structure within the hood, a means of controlling the action of the solenoid and a means of controlling said power source to control the movement of the cable and the movement of the clutch arm to control the movement of said sash in said access opening.

8. A fume hood having a sash operator clutch and drive mechanism to provide a sash operation for fume hood structures comprising a power source mounted on a stationary portion of the fume hood structure and having attached thereto by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the hood idler pulley extending to and over the dual grooved master cable pulley, the cable continuing to and over one or more further hood idler pulleys which have been mounted on said structure, said cable terminating and connecting to a freely moving weighted structure within the hood.

9. A fume hood having a sash operator clutch and drive mechanism as claimed in claim 8 wherein the clutch arm is controlled by a solenoid which is activated by an electric switch.

10. A fume hood having a sash operator, said fume hood having an access opening in one wall thereof and a closure structure therefor, including a movable sash member, disposed for movement in said access opening to vary the effective size of the opening thereof, comprising a power source mounted on a stationary portion of the structure which power source is an electrical motor and the controlling means therefor comprises limit switches disposed in an area adjacent to the power source and actuatable by means comprising a limit switch activator in a geared relationship to the power source, said power source having attached thereto, by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the first hood idler pulley extending to and over the dual grooved master cable pulley, the cable continuing to and over one or more further hood idler pulleys which have been mounted on said structure, said cable terminating and connecting to a freely moving weighted structure within the hood, a means of controlling the action of the solenoid and a means of controlling said power source to control the movement of the cable and the movement of the clutch arm to control the movement of said sash in said access opening.

11. A fume hood having a clutch and drive mechanism to provide a sash operation for the fume hood comprising a power source mounted on a stationary portion of the fume hood structure, wherein said power source is an electric motor and the controlling means therefor comprises limit switches disposed in an area adjacent to the power source and actuatable by means comprising a geared relationship to the power source, said power source having attached thereto by suitable means a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the hood idler pulley extending to and over the dual grooved master cable pulley, the cable continuing to and over one or more further hood idler pulleys which have been mounted on said structure, said cable terminating and connecting to a freely moving weighted structure within the hood.

12. A fume hood having a clutch and drive mechanism as claimed in claim 11 wherein the clutch arm is controlled by a solenoid which is activated by an electric switch.

13. A fume hood having a clutch and drive mechanism as claimed in claim 11 wherein the clutch arm is controlled by a solenoid which is activated by an electro-pneumatic switch.

14. A fume hood having a sash operator clutch and and drive mechanism to provide a sash operation for fume hood structures comprising a power source mounted on a stationary portion of the fume hood structure and having attached thereto by suitable means, a drive pulley, a freely rotatable dual grooved master cable pulley mounted on said structure and spaced some distance from said drive pulley and connected to said drive pulley by a V-belt extending between and over said drive pulley and over the dual grooved master cable pulley, a clutch mechanism disposed adjacent to said drive pulley and said dual grooved master cable pulley and comprising a solenoid mounting plate mounted on said structure, a solenoid mounted on said solenoid mounting plate, a clutch arm associated with and actuated by said solenoid and an idler wheel located at the distal end of the clutch arm opposite the solenoid, said idler wheel horizontally mounted and freely rotatable in said distal end of said clutch arm, a cable, connected to said sash member as a means of controlling said sash member, the cable extending between the sash member and a hood idler pulley which has been vertically mounted on said structure, said cable continuing over the hood idler pulley extending to and over the dual grooved master cable pulley, the cable continuing to and over one or more further hood idler pulleys which have been mounted on said structure, said cable terminating and connecting to a freely moving weighted structure within the hood by an electro-pneumatic switch.

* * * * *